US005779156A

United States Patent [19]

Crampton

[11] Patent Number: 5,779,156

[45] Date of Patent: Jul. 14, 1998

[54] SPRAY DISPENSER AND SYSTEM FOR SPRAYING VISCOUS LIQUIDS

[75] Inventor: David C. Crampton, Fountain Valley, Calif.

[73] Assignee: Par-Way Group, St.Clair, Mo.

[21] Appl. No.: 556,650

[22] Filed: Nov. 13, 1995

[51] Int. Cl.[6] ..... B05B 7/32

[52] U.S. Cl. ..... 239/337; 239/433; 239/543

[58] Field of Search ..... 239/337, 373, 239/390, 396, 433, 491, 493, 543, 544, 545

[56] References Cited

U.S. PATENT DOCUMENTS

| | | | |
|---|---|---|---|
| 1,099,028 | 6/1914 | Czarnecki . | |
| 1,144,816 | 6/1915 | Cowper . | |
| 2,242,680 | 5/1941 | Schacht . | |
| 2,657,836 | 11/1953 | Heinz . | |
| 2,721,762 | 10/1955 | Bates . | |
| 4,251,032 | 2/1981 | Werding . | |
| 4,360,156 | 11/1982 | Soth et al. | 239/493 X |
| 5,088,649 | 2/1992 | Hanson . | |
| 5,249,747 | 10/1993 | Hanson . | |
| 5,358,179 | 10/1994 | Lund . | |

FOREIGN PATENT DOCUMENTS

| | | | |
|---|---|---|---|
| 726734 | 10/1942 | Germany . | |
| 424879 | 7/1948 | Italy . | |
| 197711 | 11/1978 | U.S.S.R. . | |
| 817008 | 7/1959 | United Kingdom | 239/493 |
| 817998 | 8/1959 | United Kingdom | 239/493 |
| 1137315 | 12/1968 | United Kingdom . | |
| 1253221 | 11/1971 | United Kingdom . | |
| 9518651 | 7/1995 | WIPO . | |

*Primary Examiner*—Andres Kashnikow
*Assistant Examiner*—Steven J. Ganey
*Attorney, Agent, or Firm*—James A. Quinton

[57] ABSTRACT

A spray dispenser for dispensing and atomizing viscous liquids and a system for dispensing same is provided. The dispenser includes a reservoir for storing a viscous liquid. The viscous liquid is delivered under pressure from the reservoir to a delivery passage. A nozzle is provided with two opposed outlets to the atmosphere which provides intersecting streams of viscous liquid during dispensing.

21 Claims, 7 Drawing Sheets

SPRAY DISPENSER AND SYSTEM FOR SPRAYING VISCOUS LIQUIDS

FIELD OF THE INVENTION

The field of the invention is a dispensing system for improved atomization of high viscosity liquid products. More particularly, the present invention provides an improved hand held spray dispenser which can deliver a highly viscous liquid product in a finely atomized spray.

BACKGROUND OF THE INVENTION

Highly viscous liquids have posed a dispensing problem in the art. Vegetable oil containing products have been particularly troublesome. Considerable efforts have been made to provide spray dispensable viscous vegetable oil compositions. These compositions may contain other viscous vegetable based products such as lecithin. These products have been dispensed in aerosol form, generally using a propellant which will mix with the viscous vegetable oil and reduce the viscosity. This has resulted in the use of chlorofluoro hydrocarbons (CFCs) propellant. Alternatively, volatile organic compounds (VOCs) such as isobutane or propane have been used. Such propellants are now considered pollution problems. Pump sprayable dispensing systems for viscous vegetable oil have also generally required dilution of vegetable oil to reduce its viscosity.

Pump sprayable dispensing systems for viscous liquids have consequently been developed. For example, U.S. Pat. No. 5,088,649 describes a colliding stream hand pump sprayer which can dispense a fine spray of viscous liquids without the need for using diluents. U.S. Pat. No. 5,358,179 discloses a colliding stream sprayer having a molded nozzle. However, the manufacture of such devices can be cumbersome. In manufacture, the two outlets which provide the colliding streams have to be either drilled after molding of the nozzle or formed during injection molding by using releasable pins. Such processes have proved unsatisfactory. Aerosol containers also have been described in the prior art which having colliding streams which improve the break up of viscous fluid. For example, U.S. Pat. No. 5,249,747 describes such a system which uses compressed gases as propellants instead of a CFC or VOC propellant. However, the quantity of liquid product dispensed and the quality of the spray pattern are important. In the prior art, there can be uneven distribution of the viscous liquid and undesirable heavy concentration areas from the colliding stream sprayers.

Accordingly, it would be desirable to provide a hand held dispensing system for viscous liquids which would provide an improved spray pattern which would eliminate any undesirable concentration of product and provide for a more even distribution. It is also desirable to provide a nozzle for a colliding stream spray dispensing system which can be injection molded without the use of pins to supply the outlets or without drilling the outlets after molding.

SUMMARY OF THE INVENTION

The present invention relates to an improved viscous liquid dispensing system. The invention also relates to an apparatus for dispensing viscous liquids without the need to use diluents or VOC or CFC propellants.

It is an object of the invention to provide a viscous liquid dispensing system which can dispense viscous coatings in a fine mist.

It is an object of the invention to provide an aerosol dispensing system which can use compressed gases such as nitrogen, carbon dioxide, nitrous oxide or a noble gas as propellant, while still providing a finely atomized product. Compressed gases as denoted by the aerosol industry are defined as a gas that can be liquified only by the application of very low temperatures or very high pressure. Compressed gases include carbon dioxide, nitrous oxide and nitrogen. Freon, butane, and pentane are not considered compressed gas propellants.

It is an object of the invention to provide a viscous liquid dispensing system which provides a uniform fine spray and which has minimal areas of heavy concentration of liquid.

It is an object of the invention to provide a nozzle for a spray dispensing system having colliding streams which can be injection molded without the use of molding pins to provide the nozzle outlets.

Other further objects will become apparent from the specification drawings and claims.

According to the invention, a multiple hole, preferably a two hole spray dispenser in which colliding streams of viscous fluid are dispensed to the atmosphere is provided. The spray dispenser according to the invention includes a reservoir for storing a fluid product. An aerosol or manually pressurized dispensing system preferably a hand held dispensing system may be used to pressurize the reservoir. Liquid is delivered from the reservoir under pressure to a delivery passageway. A nozzle having two or more outlets to the atmosphere is mounted to the delivery passageway. The nozzle includes a post, desirably, a cylindrical post which is mounted across the delivery passageway. A fluid flow path is formed around the outside of the post to receive fluid, preferably viscous liquids from the delivery passageway. The fluid flows between the space between the post and the walls of the delivery passageway. The nozzle outlets are formed from a first and second groove which are located on opposite surfaces of the post. The grooves extend along the cylindrical post in the direction of fluid flow. A groove containment cap is provided. The groove containment cap has a large central passageway on its inlet side and a single centrally located orifice on its outlet side. The side walls of the orifice of the groove containment cap forms the top of the grooves adjacent to the point where the fluid exits to the atmosphere. The remainder of the cap orifice is blocked off by the post extending through the orifice in groove containment cap. As a result, the viscous liquid flowing in the fluid flowpath is forced to travel along the groove to the atmosphere.

The post can be a variety of shapes, for example, square, rectangular, conical, cylindrical, preferably cylindrical. Preferably, the central passageway and the groove confinement cap have the same general shape as does the post.

The grooves on the post have a maximum depth at their outlet end and a minimum depth at their inlet end. The groove depth changes at a uniform rate which has been preselected depending on the exit angle desired for the intersecting flowpaths exiting from the grooves. As a result, two exit openings are provided for the fluid. The existing viscous liquid travels along preselected intersecting discharge axes. The exiting fluid streams collide at a preselected collision point after the viscous liquid has been discharged from the nozzle. The exiting viscous liquid streams generally follow the slope of the groove floor. However, the upper portion of the stream expands and is partially atomized prior to the collision point where additional atomization takes place.

The resulting dispensing system delivers viscous liquids in a fine mist with more even distribution and a reduction in the areas of undesirable high concentration spots. In addition, the nozzle according to the invention can be manufactured by injection molding without the use of expensive pins or without drilling.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
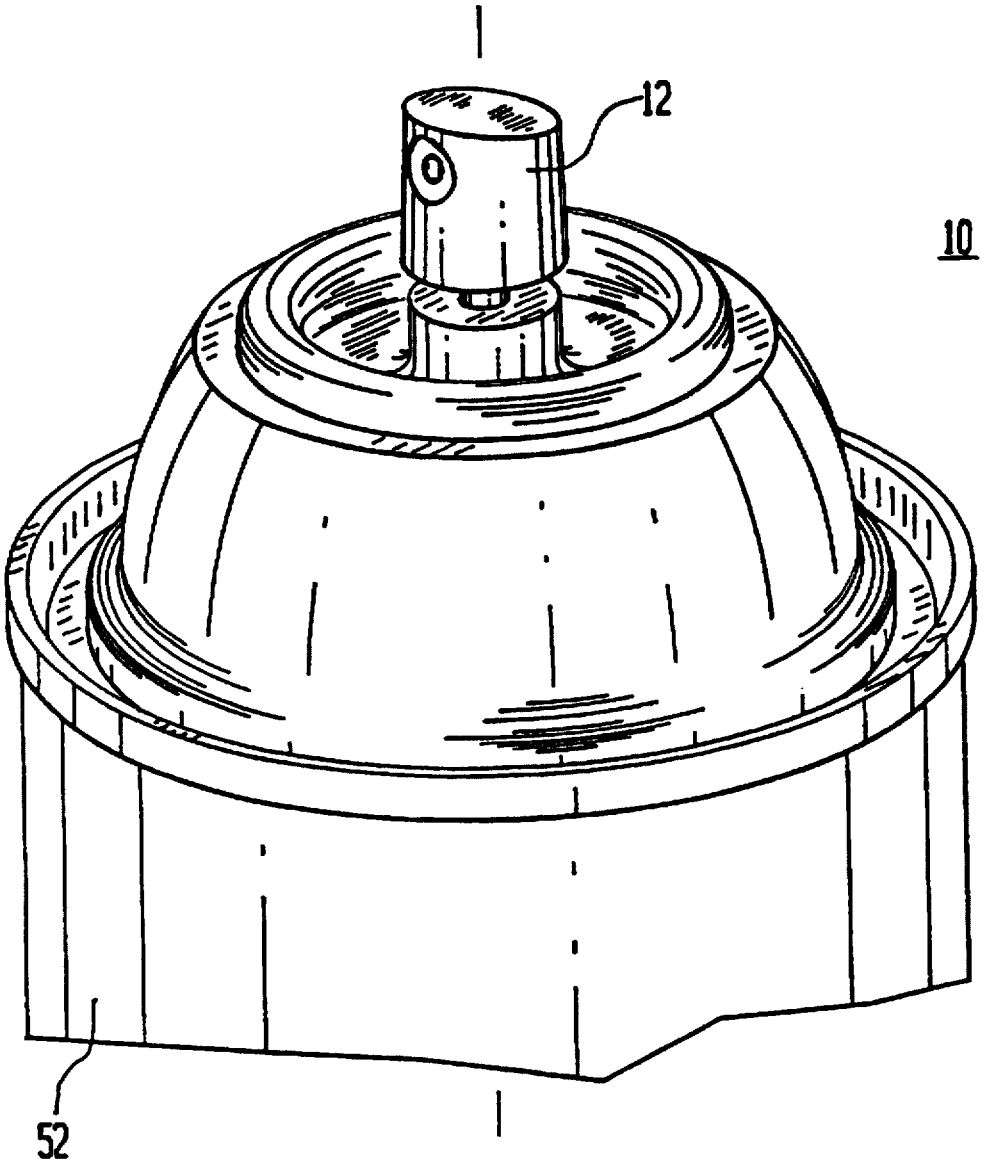
FIG. 1 is a perspective view of a spray dispenser according to the invention.

According to the invention, a spray dispenser for spraying liquid products in a fine atomized spray is provided. Preferably, the liquid to be sprayed is a highly viscous liquid, having a viscosity of above 60 cps, preferably from 60 cps to 100 cps, most preferably from 70 to 85 cps. The spray dispensing system according to the invention is useful with numerous different systems for delivery pressurized fluid to a delivery passageway. Preferably, a hand held spray dispenser such as an aerosol, a hand pump or a finger pump sprayer is used. Optionally, a bladder type sprayer can be used. Many different types of viscous products, that is, viscous liquids can be dispensed in a fine mist according to the invention. Viscous organic liquids, particularly vegetable oil and/or vegetable oil, lecithin compositions are particularly useful. Such products generally have a viscosity of about 60 cps and above, and are considered difficult to spray dispense. Preferably, the viscosity is from about 60 cps to about 100 cps, desirably from about 60 cps to about 85 cps and most preferably from about 70 cps to about 85 cps. Additionally, other viscous liquids may be used such as paint pigments in linseed oil, viscous petroleum products, lubricants, adhesives and/or resins. Resins could include hairspray or other viscous resins. The spray dispenser according to the invention includes a reservoir for storing a fluid product. Fluid is drawn from a reservoir and delivered into a delivery passageway under pressure. A nozzle having multiple outlets preferably two outlets to the atmosphere is mounted to a delivery passageway interconnected with a reservoir from which a viscous liquid is delivered under pressure. The nozzle includes a post, preferably a cylindrical post which is mounted across the delivery passageway. A fluid flowpath is formed around the cylindrical post within the delivery passageway to receive the pressurized viscous liquid. The nozzle includes at least two outlets through which the viscous liquid exits in colliding flowpaths. The viscous liquid exiting from one orifice collides at a preselected collision point with the viscous liquid exiting from the other orifice.

The nozzle outlets are formed from a first and second groove which are located on opposite surfaces of a cylindrical post and extend in the direction of fluid flow along the cylinder. The grooves extend along the cylindrical post from the outlet end to the inlet end of the cylindrical post. Preferably, the grooves extend from a point intermediate to the inlet and outlet ends of the cylindrical post and end at the outlet end of the cylindrical post.

A groove containment cap is provided. The groove containment cap has a large central passageway on its inlet side and a centrally located orifice at its outlet end. The side walls of the groove containment cap orifice provides a top confinement for the grooves adjacent to the point where the viscous liquid exits to the atmosphere. The remainder of the groove containment cap orifice is blocked off by the cylindrical post extending through the orifice in the groove containment cap. The post can be a variety of shapes, for example, square, rectangular, conical, cylindrical, preferably cylindrical. The shape of the central passageway and the groove confinement cap preferably have the same general shape as does the post.

Assembled, the cylindrical post blocks off the central located orifice in the groove containment cap except for the fluid flowpath provided by the first and second grooves. The grooves are preferably located on opposite side of the cylindrical post. The grooves provide for an intersecting stream of fluid at the outlet of the spray dispenser. The grooves have a maximum depth at their outlet end and a minimum depth at the inlet end. The groove floor slopes downward at a uniform preselected rate depending on the impingement angle desired at the intersecting flowpaths exiting from the grooves. As a result, two exit openings are provided for the fluid in the nozzle. The exiting viscous liquid travels along preselected intersecting discharge axes. The exiting fluid streams collide at a preselected collision point at a preselected impingement angle. Preferably, an impingement angle of 10° to 170° is preferred. Desirably, the impingement angle is about 50° to 70°, most preferably about 60°. Preferably, the containment cap is located at a point prior to the termination of the grooves at the outlet end of the cylindrical post. Thus, grooves provide a bottom and side surface for bottom and side confinement of the exiting viscous liquid when it emerges from the spray dispenser. The exiting viscous liquid generally follows the sloping groove floor on the intersecting flowpath provided by the groove. The upper portion of the exiting viscous liquids streams expand as the fluid is ejected from the spray dispenser. The exiting liquid is partially atomized prior to reaching the collision point. Additional atomization takes place at the collision point. The resulting dispensing system provides a fine mist of viscous fluid with improved distribution and a reduction of undesirable high concentration spots of fluid. The product can be simply injection molded without the need for drilling or providing pins which complicate the injection molding process.

Alternatively, the grooves may be provided on the interior wall of the delivery passageway. In such embodiment, the groove containment cap will be replaced by a plug or post snugly fitted within the passageway but terminating prior to the termination of the grooves on the outlet side of the delivery passageway to provide top confinement of the grooves. As a result, two outlets will be provided with intersecting fluid paths similar to the post groove containment cap embodiment.

Referring to the drawings, as best seen in FIGS. 1–7, a spray dispenser according to the invention is provided. Preferably, aerosol dispenser 10 having a liquid reservoir 52 for storing a viscous liquid product is provided. Alternatively, according to a manual pump, such as a hand pump or finger pump spray dispenser 80, which includes a nozzle having a post 84 and groove containment cap 86 is provided. See FIG. 8.

Figure 2:
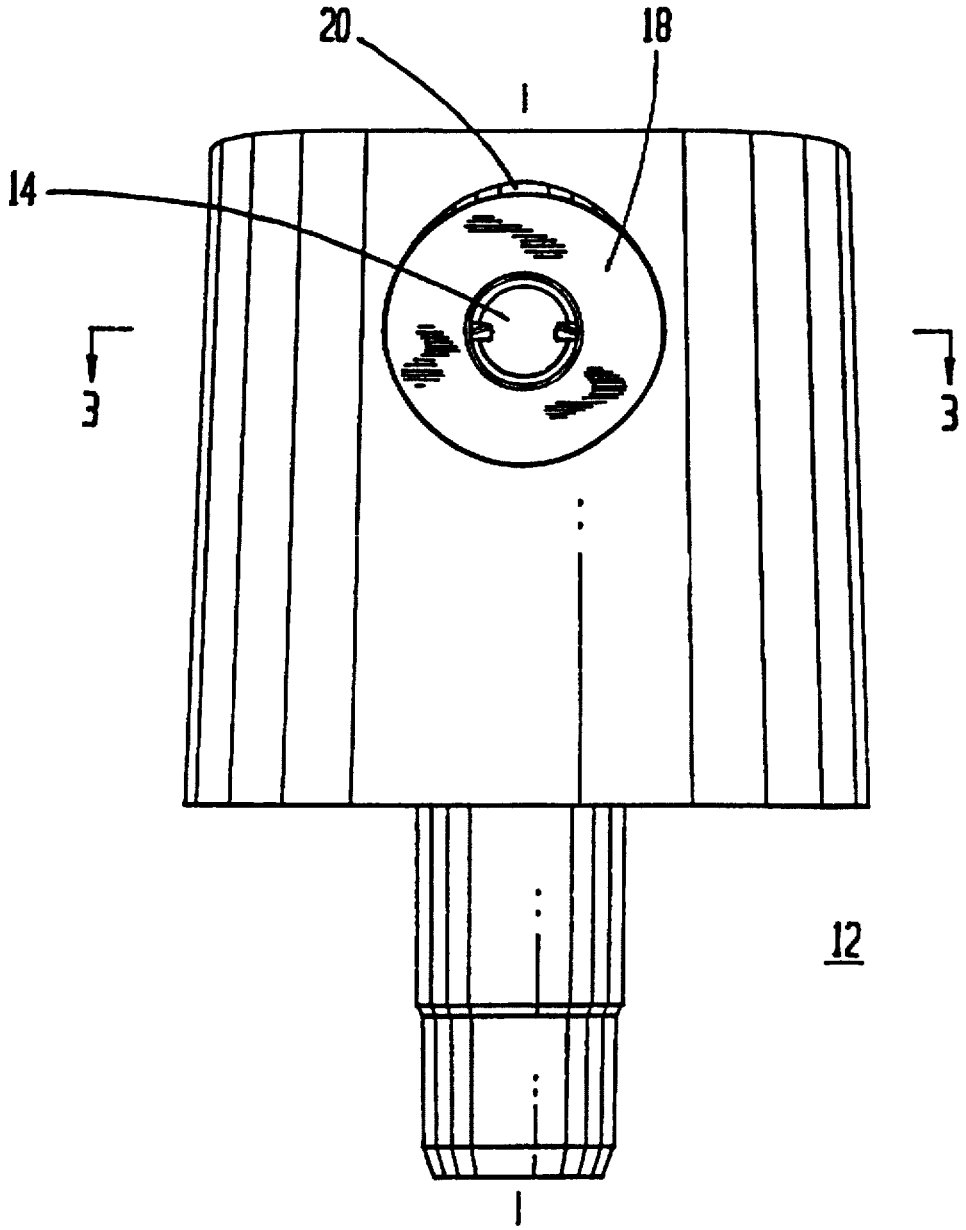
FIG. 2 is a partial front view of FIG. 1 showing the actuator.
Figure 3:
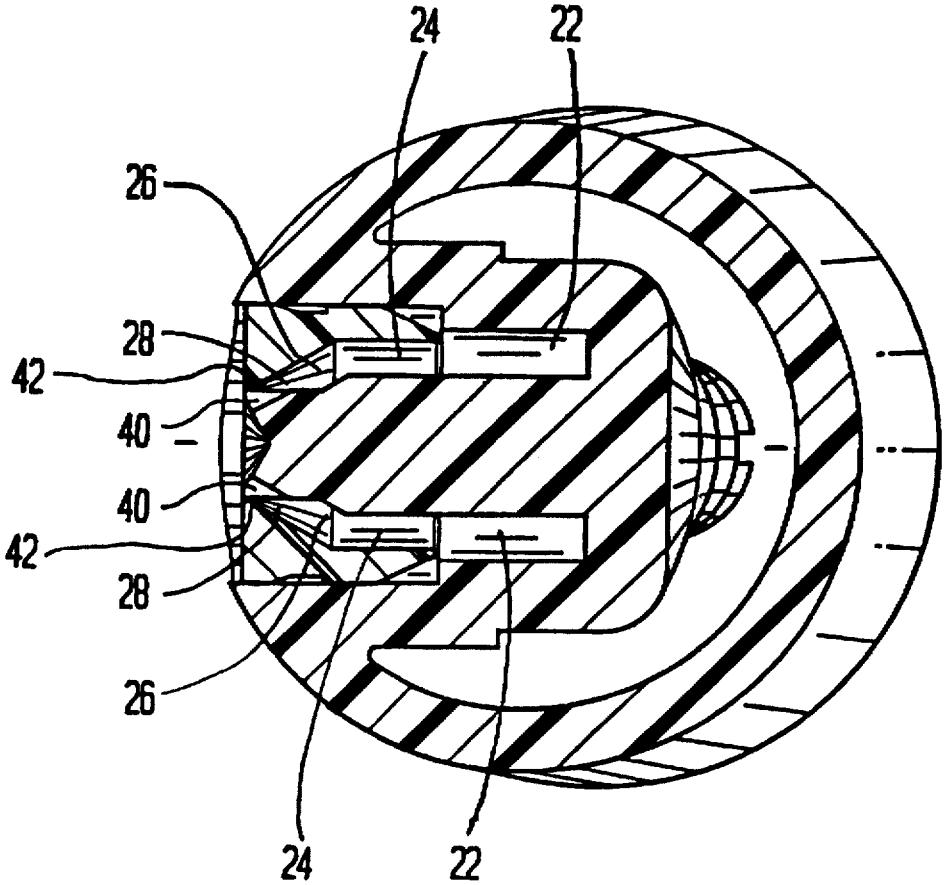
FIG. 3 is a sectional view through 3—3 of FIG. 2.
Figure 4:
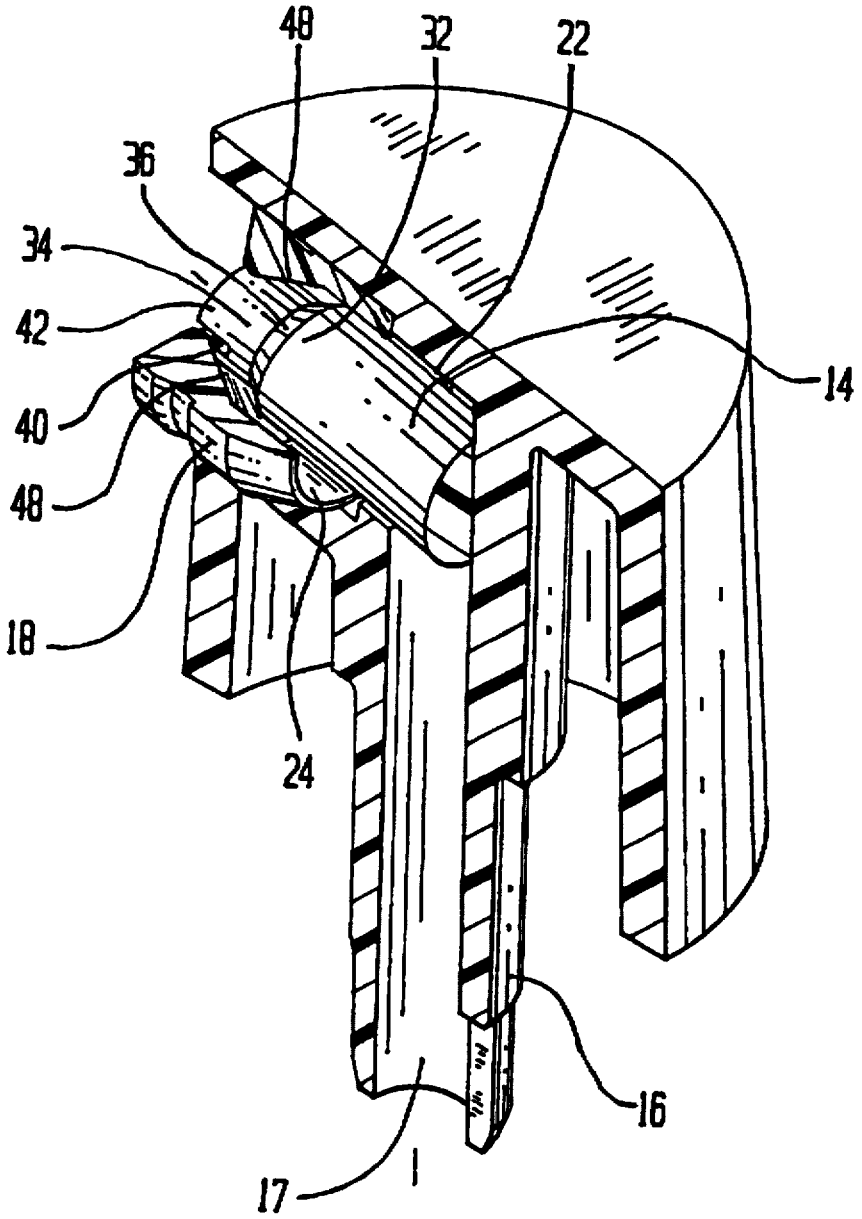
FIG. 4 is an isometric sectional view of FIG. 2.
Figure 7:
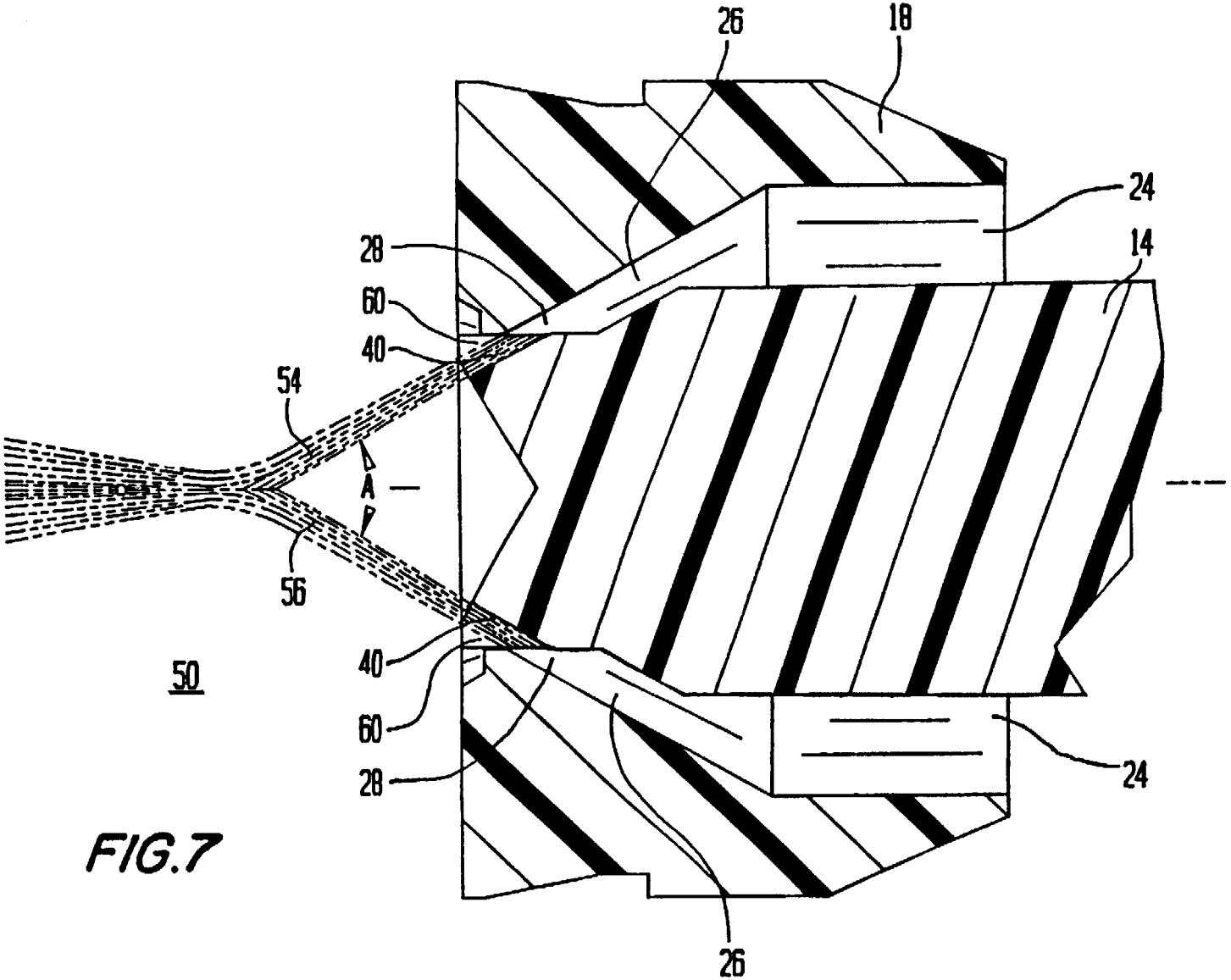
FIG. 7 is a partial view of the post and groove containment cap assembled.
Figure 8:
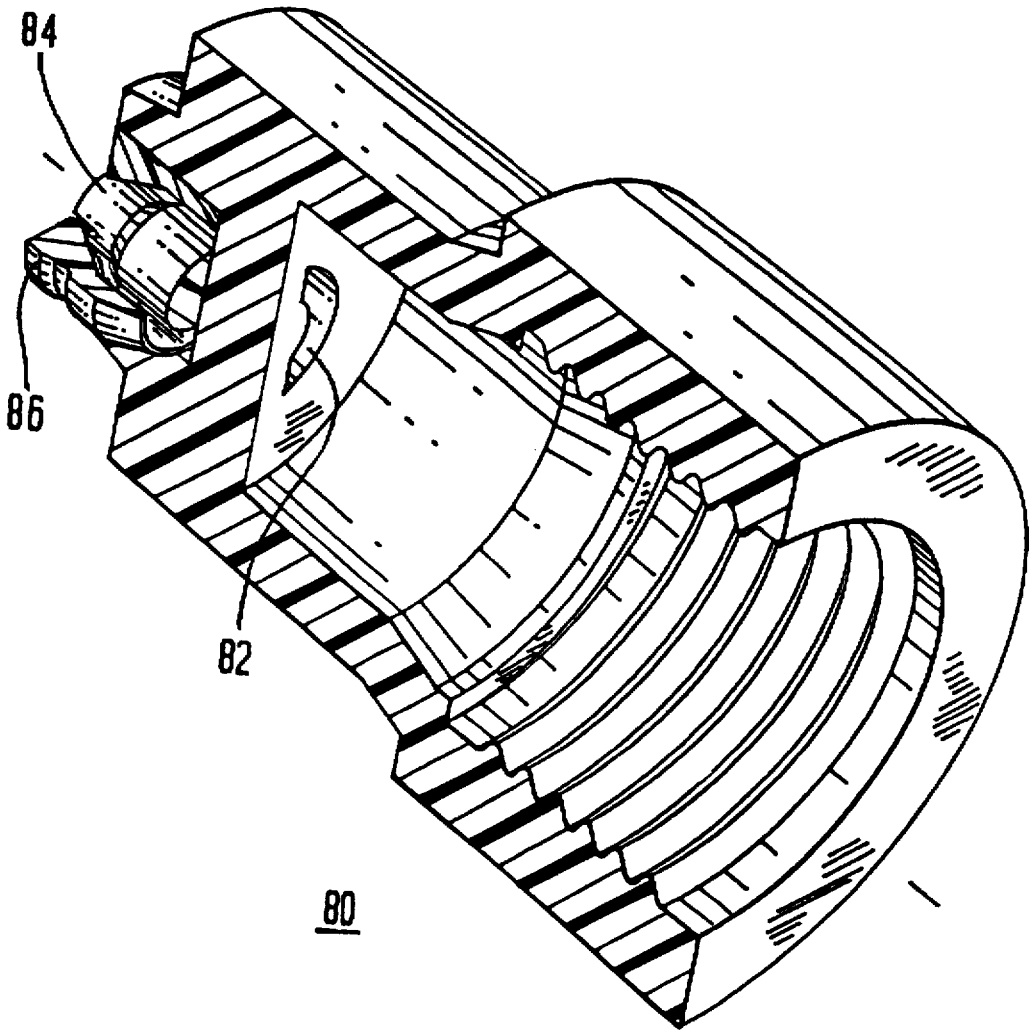
FIG. 8 is an isometric sectional view of an alternative embodiment of the spray dispenser according to the invention.

Referrring to FIG. 7, liquid, preferably a viscous liquid is delivered from reservoir 52 under pressure into a delivery passageway which is in fluid communication with pressurized fluid from the reservoir. As shown in FIGS. 2 to 4, an actuator, desirably an aerosol button 12 is provided. The button 12 includes a button stem 16 and a stem channel 17 which interconnects with the reservoir 52 of aerosol container 10. Pressurized viscous liquid travels through channel 17 to a delivery passageway 20 in button 12. Preferably, delivery passageway 20 is cylindrical and is adapted for receipt of groove containment cap 18.

Nozzle 50 is composed of two principle injection molded parts, cylindrical post 14 and groove containment cap 18. Desirably, cylindrical post 14 can be injected molded integrally with button 12. A post, preferably cylindrical post 14 is provided and mounted in delivery passageway 20. A fluid flowpath is generally formed around the outside of cylindrical post 14 between the outside surface of the cylindrical post 14 and the delivery passageway 20. Preferably, cylindrical post 14 is composed of three integral sections. A larger diameter cylindrical post back 32 and a smaller diameter concentric cylindrical post front 34 are provided. Sloping post surface 36 connects post back 32 and post front 34. Optionally, a cylindrical post 14 having a uniform diameter is provided. By providing a larger diameter on the inlet side of the cylindrical post, added strength is added to the nozzle. Post 14 includes at its outlet end a plurality of fluid flow grooves, preferably first and second grooves 40 located on the surface of the cylinder extending in the direction of fluid flow along the surface of the cylinder. Preferably grooves 40 are located on opposite sides of cylindrical post 14. The grooves 40 have a maximum depth at their outlet end and a minimum depth at the inlet end. The groove depth changes at a uniform rate. This rate of change of groove depth has been preselected depending on the impingement angle A desired for the intersecting flowpath required from the streams of liquid exits 54 and 56 exiting from the grooves. As best seen in FIG. 7, the depth 60 of groove 40 flares outwardly from its inlet end to its outlet end. The increase in the depth 60 of groove 40 is dependant on the preselected angle of impingement (Angle A) for the colliding streams of exiting viscous liquids 54 and 56. Preferably, angle A is from 10° to 170°, more preferably, from 50° to 70° and most preferably at about 60°.

Figure 5:
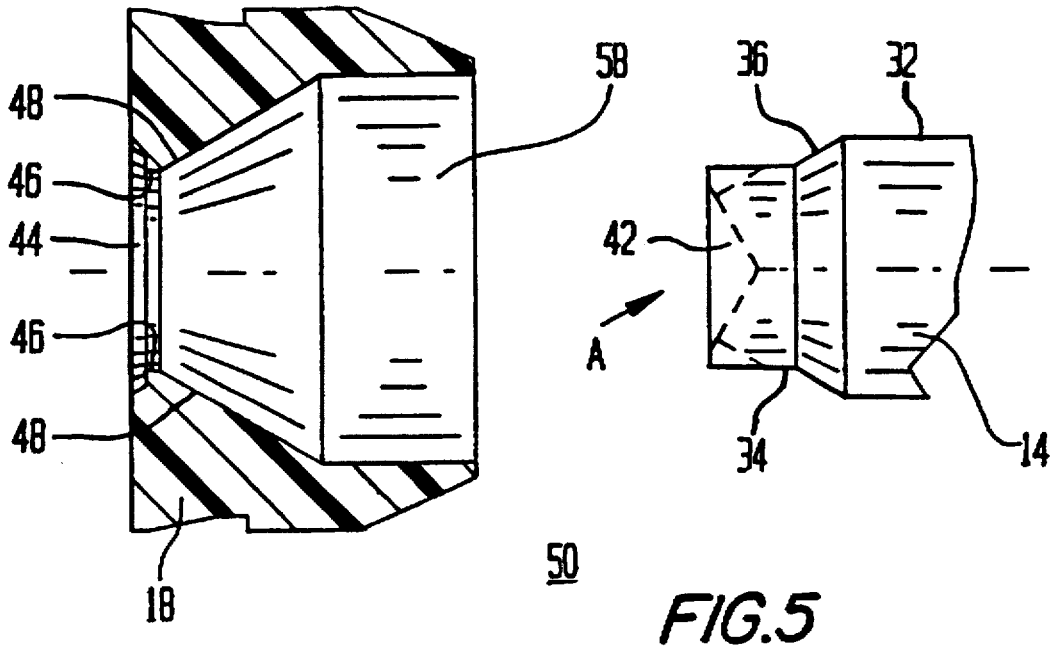
FIG. 5 is an exploded sectional view of the post and groove containment cap of FIG. 2.
Figure 6:
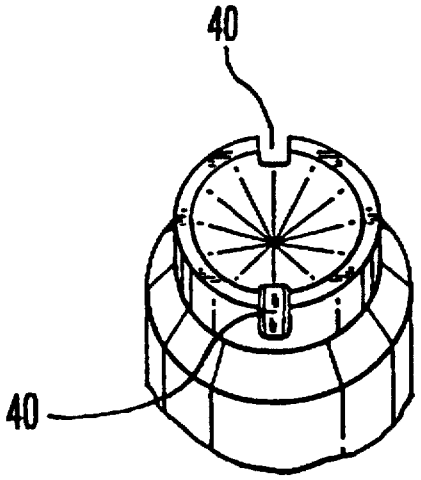
FIG. 6 is a front view along direction A of FIG. 5.

Groove containment cap 18 is provided. Groove containment cap 18 has a centrally located orifice preferably flared opening 44 which is adapted for receipt and snug engagement of cylindrical post 14. Groove containment cap 18 has a central passageway channel 58 for receipt of cylindrical post 14 and for the flow of fluid to the outlet end of the cylindrical post 14. The flared opening 44 tapers on the inlet side thereof. A contact surface 46 is provided on the inlet side of flared opening 44. Contact surface 46 engages cylindrical post contact surface 42 around the entire periphery of the outlet end of cylindrical post 14. Contact surface 46 cuts off the flow of fluid through the nozzle and directs fluid flow to the atmosphere along the grooves 40. Contact surface 46 also provides the top of grooves 40 adjacent to the outlet end of cylindrical post 14. Preferably, at the outlet of cylindrical post 14, the grooves 40 extend for some distance past the intersection of contact surface 46 with grooves 40. Preferably the grooves extend past the intersection of contact surface 46 and post contact surface 42. As best seen in FIG. 5, desirably interior channel 58 is generally conical in shape and has sloping interior wall surface 48. As a result, two fluid outlets are provided in nozzle 50 through opening 44 in groove containment cap 18. Grooves 40 preferably extend past the point of contact between the groove containment cap 18 and cylindrical post 14. The exiting viscous liquid streams generally follow the slope of the groove faces of groove 40. The upper portion of the stream which is unconfined, partially atomizes prior to the collision point for the intersecting streams.

The fluid flowpath in the nozzle 50 includes a first cylindrical channel 22 which is formed between the cylindrical post 14 and the interior of delivery passageway 20. A second cylindrical channel 24 is formed between the post back 32 and containment cap 18. A tapered channel 26 is provided between the sloping surface 36 of the cylindrical post 14 and the interior of groove containment cap 18. A third cylindrical channel 28 is provided between the post front 34 and the sloping surface 48 of containment cap 18.

In operation, viscous liquid is brought from stem channel 17 to delivery passageway 20 upon the engagement of aerosol button 12. The fluid then flows through cylindrical channels 22, 24, 26 and 28 and eventually reaches the outlet end of cylindrical post 14. Fluid then exits nozzle 50 through the space provided between the groove confinement cap 18 and the cylindrical post 14 along grooves 40. The exiting viscous streams generally follow the sloping path provided by the extension of grooves 40 past containment cap 18. The upper portion of the stream however expands somewhat as it partially atomizes upon its expulsion from the spray dispenser. Due to the slope of the grooves 40, the exiting streams 54 and 56 are angled toward one another for intersection at a pre-selected collision point where additional atomization takes place. As a result, a spray having a fine mist and having reduced areas of liquid concentration spots is provided. The nozzles according to the invention are useful in practicing the invention of U.S. Pat. No. 5,088,649 (Hanson) and 5,249,747 (Hanson) which are hereby incorporated by reference.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A spray dispenser for dispensing and atomizing liquid comprising:

a. a reservoir for storing a viscous liquid;

b. means to deliver viscous liquid under pressure from said reservoir to a delivery passageway;

c. a nozzle having two outlets which provide intersecting streams of viscous liquid during dispensing; said nozzle including:

i. a post having an inlet end and an outlet end in fluid communication with the viscous liquid in said delivery passageway; said post mounted in said delivery passageway to form a fluid flowpath between said post and said delivery passageway;

ii. a first groove and a second groove located on said post;

iii. said first and second grooves having a preselected length and extending to said outlet end of said post;

iv. a groove containment cap mounted in said delivery passageway, said cap located at a preselected point along said first and second groove to provide top confinement to said grooves at a preselected point intermediate to the outlet end of said post so that said grooves have top confinement for at least a portion of their length; said groove containment cap terminating prior to termination of said grooves at the outlet end of said post whereby said grooves extend along said post from said groove containment cap to the post outlet end without top confinement;

v. said grooves having a preselected greater depth at the outlet end of said post than at the inlet end of said post so that fluid flowing along said first groove intersects with fluid flowing along said second groove at a preselected impingement angle after said fluid is discharged from the dispenser;

vi. said grooves providing a flow path for viscous liquids during dispensing;

vii. means to direct fluid flowing along said flow path through said outlets during dispensing;

viii. said groove containment cap having a central outlet for snug receipt and engagement of said post;

ix. said central outlet having side walls;

x. said side walls engaging said post and providing said top confinement of said grooves prior to dispensing said viscous liquid.

2. A spray dispenser for dispensing and atomizing liquid comprising;

a. a reservoir for storing a viscous liquid;

b. means to deliver viscous liquid under pressure from said reservoir to a delivery passageway;

c. a nozzle having two opposed outlets which provide intersecting streams of viscous liquid during dispensing; said nozzle including:

i. a cylindrical post having an inlet end and an outlet end mounted across said delivery passageway to form a fluid flowpath between said cylindrical post and said delivery passageway;

ii. a first groove and a second groove located on opposite surfaces of said cylindrical post;

iii. said first and second grooves having a preselected length and extending to said outlet end of said cylindrical post;

iv. a groove containment cap mounted in said delivery passageway, said cap located at a preselected point along said first and second groove to provide top confinement to said grooves at a preselected point intermediate to the outlet end of said cylindrical post so that said grooves have top confinement for at least a portion of their length; said groove containment cap terminating prior to termination of said grooves at the outlet end of said cylindrical post whereby said grooves extend along said cylindrical post from said groove containment cap to the cylindrical post outlet end without top confinement;

v. said grooves having a pre-selected greater depth at the outlet end of said cylindrical post than at the inlet end of said cylindrical post so that fluid flowing along said first groove intersects with fluid flowing along said second groove at a preselected impingement angle after said fluid is discharged from the dispenser;

vi. means to direct fluid flowing along said fluid flow path through said outlets during dispensing;

vii. said grooves providing a flow path for viscous liquids during dispensing;

viii. said groove containment cap having a central outlet for snug receipt and engagement of said post;

ix. said central outlet having side walls;

x. said side walls engaging said lost and providing said top confinement of said grooves prior to dispensing said viscous liquid.

3. The spray dispenser according to claim 2 wherein said grooves extend from said outlet end of said cylindrical post to a point intermediate to the inlet end.

4. The spray dispenser according to claim 2 wherein said means to deliver said viscous liquid to said delivery passageway is an aerosol container;

a propellant to pressurize said reservoir; said propellant selected from the group consisting essentially of compressed gas propellants and noble gases.

5. The spray dispenser according to claim 4 wherein said propellant is selected from the group consisting essentially of carbon dioxide, nitrogen and nitrous oxide.

6. The spray dispenser according to claim 4 wherein said impingement angle is from about 10° to about 170°.

7. The spray dispenser according to claim 6 wherein said impingement angle is from about 50° to about 70°.

8. The spray dispenser according to claim 7 wherein said impingement angle is about 60°.

9. The spray dispenser according to claim 2 wherein said means to deliver said viscous liquid to said delivery passageway is a manually operated pump sprayer.

10. A spray dispensing system for dispensing and atomizing viscous liquid comprising;

a. a reservoir for storing a viscous liquid;

b. a viscous liquid having a viscosity of about 60 cps or greater;

c. means to deliver said viscous liquid under pressure from said reservoir to a delivery passageway;

d. a nozzle having two outlets which provide intersecting streams of viscous liquid during dispensing; said nozzle including:

i. a post having an inlet end and an outlet end mounted in said delivery passageway to form a fluid flowpath between said post and said delivery passageway;

ii. a first groove and a second groove located on the surface of said post;

iii. said first and second grooves having a preselected length and extending to said outlet end of said post;

iv. a groove containment cap mounted in said delivery passageway, said cap located at a preselected point along said first and second groove to provide top confinement to said grooves at a preselected point intermediate to the outlet end of said post so that said grooves have top confinement for at least a portion of their length; said cap terminating prior to termination of said grooves at the outlet end of said post whereby said grooves extend along said post from said groove containment cap to the post outlet end without top confinement;

v. said grooves having a preselected greater depth at the outlet end of said post than at the inlet end of said post so that fluid flowing along said first groove intersects with fluid flowing along said second groove at a preselected impingement angle after said fluid is discharged from the dispenser;

vi. means to direct fluid flowing along said fluid flow path through said outlets during dispensing;

vii. said grooves providing a fluid path to the atmosphere for viscous liquids during dispensing.

11. A spray dispensing system according to claim 10 wherein said post is a cylindrical post.

12. A spray dispensing system according to claim 11 wherein said first and second grooves are located on opposite surfaces of said cylindrical post.

13. The spray dispensing system according to claim 11 wherein said grooves extend from said outlet end of said cylindrical post to a point intermediate to the inlet end.

14. The spray dispensing system according to claim 13 wherein said propellant is selected from the group consisting essentially of carbon dioxide, nitrogen and nitrous oxide.

15. The spray dispensing system according to claim 14 wherein said impingement angle is from about 50° to about 70°.

16. The spray dispensing system according to claim 14 wherein said impingement angle is about 60°.

17. The spray dispensing system according to claim 16 wherein the viscous liquid is an adhesive.

18. The spray dispensing system according to claim 11 wherein said means to deliver said viscous liquid to said delivery passageway is an aerosol container;

a propellant to pressurize said reservoir; said propellant selected from the group consisting essentially of compressed gas propellants and noble gases.

19. The spray dispensing system according to claim 11 wherein said impingement angle is from about 10° to about 170°.

20. The spray dispensing system according to claim 10 wherein said viscous liquid is selected from the group consisting essentially of vegetable oil, paint pigment in linseed oil, petroleum product, lubricants, adhesives and resins.

21. The spray dispensing system according to claim 20 wherein the viscous liquid is a vegetable oil.

* * * * *